US006637139B1

(12) United States Patent
Chan

(10) Patent No.: US 6,637,139 B1
(45) Date of Patent: Oct. 28, 2003

(54) HINGEDLY ARTICULATED IMAGE DISPLAY PANEL DEVICE

(75) Inventor: Sik-Leung Chan, New Territories (CN)

(73) Assignee: C. C. & L Company Limited, Tsuen Wan (CN)

( * ) Notice: Subject to any disclaimer, the term of this patent is extended or adjusted under 35 U.S.C. 154(b) by 0 days.

(21) Appl. No.: 10/321,034

(22) Filed: Dec. 17, 2002

(51) Int. Cl.[7] ..... A47G 1/06

(52) U.S. Cl. ..... 40/725; 40/733; 40/781; 40/779

(58) Field of Search ..... 40/725, 733, 781, 40/661.06, 610, 747, 779; 248/472, 474

(56) References Cited

U.S. PATENT DOCUMENTS 3,178,842 A * 4/1965 Zimmerman ..... 40/661.06
4,371,077 A * 2/1983 Solitt et al. ..... 248/472
5,887,373 A * 3/1999 Byers ..... 40/733

* cited by examiner

*Primary Examiner*—Gary Hoge
(74) *Attorney, Agent, or Firm*—Alix, Yale & Ristas, LLP

(57) ABSTRACT

An image display device includes a base. A proximal panel is connected to the base by a spring-loaded hinge and has an image display area. A distal panel is connected directly or indirectly to the proximal panel via a spring-loaded hinge and also has an image display area. A catch co-operates with the base and the distal panel to release the proximal and distal panels from a storage configuration alongside the base to be moved by action of the spring-loaded hinges to a display configuration.

11 Claims, 3 Drawing Sheets

HINGEDLY ARTICULATED IMAGE DISPLAY PANEL DEVICE

BACKGROUND OF THE INVENTION

The present invention relates to image display panels. More particularly, although not exclusively, the invention relates to a hingedly articulated photo display or mirror panel device having spring-loaded dampened hinges connecting two or more fold-down panels. One or each panel might display a photograph or other graphic image or a mirror pane for example.

It is known to provide photo frames, personal mirrors, electronic calculators, and digital clocks for example in the form of a fold-down device. Such devices include a support base from which the display panel pivots upon a spring-loaded dampened hinge. However, where one might desire to display several photographs, graphic images, electronically generated images, or such images as well as another image such as a reflection in a mirror, a more advanced system would be needed in order to obviate the need for multiple discreet space-wasting devices.

OBJECTS OF THE INVENTION

It is the object of the present invention to provide an improved device comprising multiple panels hingedly interconnected for displaying images.

DISCLOSURE OF THE INVENTION

There is disclosed herein an image display device comprising:

a base, a proximal panel connected to the base by a spring-loaded hinge and comprising an image display area, distal panel connected directly or indirectly to the proximal panel via a spring-loaded hinge and also comprising an image display area, and a catch releasably attaching the distal panel to the base and activatable to release the proximal and distal panels from a storage configuration at the base to be moved by action of the spring-loaded hinges to a display configuration.

Preferably the hinges each comprise co-linear cylinders connected by a shaft.

Preferably the shaft is connected to a coil spring that is located within one of the cylinders to rotationally bias the other cylinder.

Preferably there is a viscous lubricant between the shaft and said one of the cylinders.

Preferably the other of said cylinders has a non-circular hollow co-operating with projections of the shaft so as to rotate therewith.

Preferably the device further comprises an end cap attached to the shaft through an end of said other of the cylinders.

Preferably the end cap comprises a projection that co-operates non-rotationally with the projections of the shaft.

One or each said image display area might receive a photograph or a mirror.

Preferably the proximal and distal panels are received within the base when in the storage configuration.

Preferably the catch is attached pivotally to the base and comprises a lip that co-operates with an edge of the distal panel.

BRIEF DESCRIPTION OF THE DRAWINGS

A preferred form of the present invention will now be described by way of example with reference to the accompanying drawings, wherein.

DESCRIPTION OF THE PREFERRED EMBODIMENTS

Figure 1:
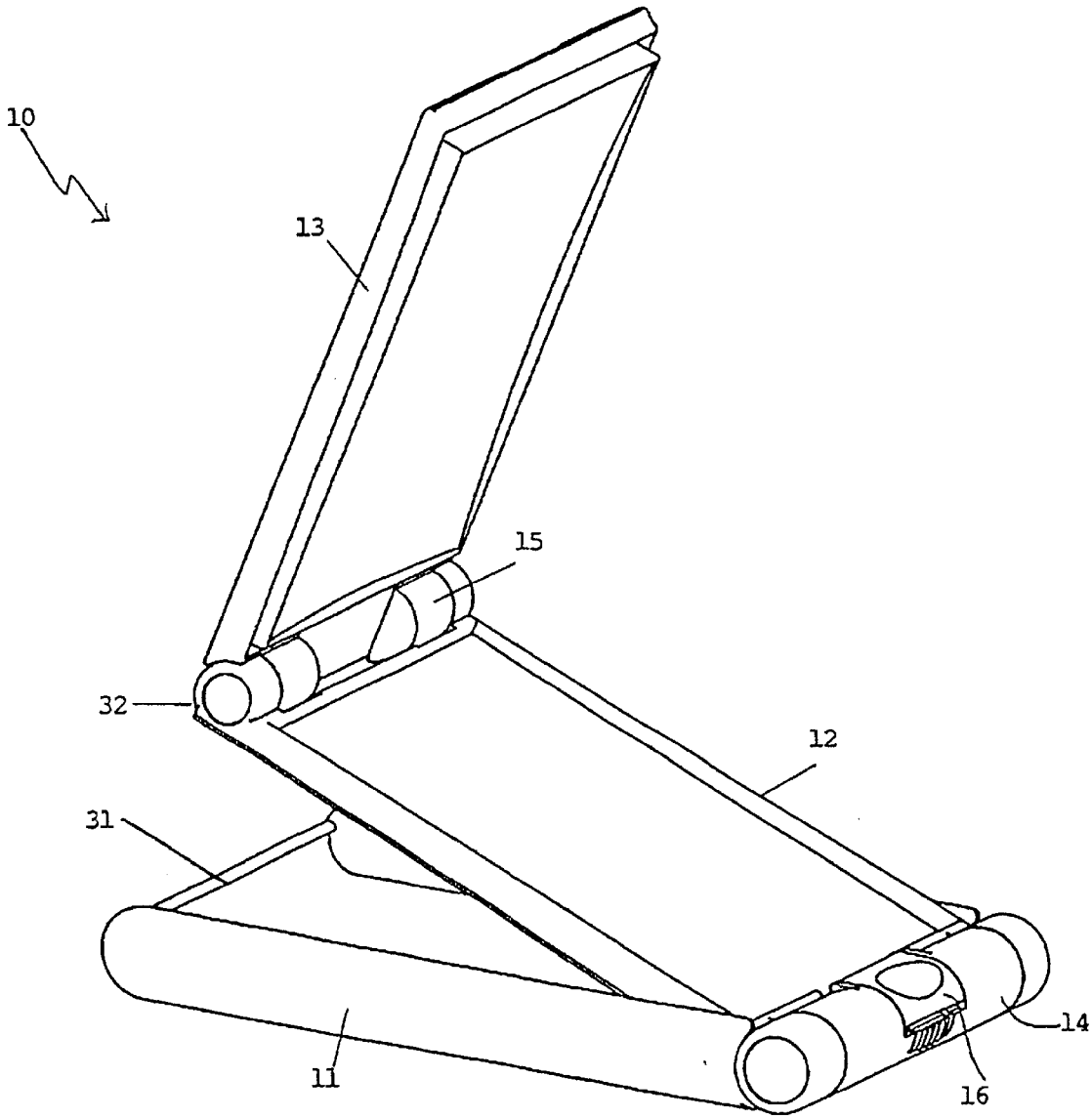
FIG. 1 is a schematic perspective illustration of a hingedly articulated photo/mirror panel device in a partially opened configuration.

In the accompanying drawings there is depicted schematically a display panel device 10. Device 10 is typically fabricated from moulded plastics material, but might alternatively be formed of machined aluminum, brass or stainless-steel for example.

The device 10 includes a base 11 having a pair of parallel sidewalls between which hingedly articulated display panels 12 and 13 can be received when folded down into a closed configuration.

A hinge 14 attaches the proximal display panel 12 to the base 11. Another hinge 15 attaches the distal display panel 13 to the proximal panel 12.

Each hinge 14, 15 comprises an inboard cylindrical portion or portions 19 formed integrally with the base 11 (or the lower end of the distal panel 12 as the case may be) flanked by a pair of outboard cylindrical portions 20 attached to the lower end of the proximal panel 12 (or its upper end). A hollow shaft 18 fits within each inboard cylindrical portion 19. Located within each shaft 18 there is a coil spring 17. One end of the coil spring 17 is attached to the interior of the respective inboard cylindrical portion 19 and the other end is attached to the interior of the respective shaft 18. Remote ends of each shaft 18 have parallel projections 23 that are received within square openings 26 of the respective outboard cylindrical portions 20. End caps 21 are fitted into the distal ends of the outboard cylindrical portions 20 and each comprise a projection 22 that fits between the projections 23 of the shaft 18.

Figure 2:
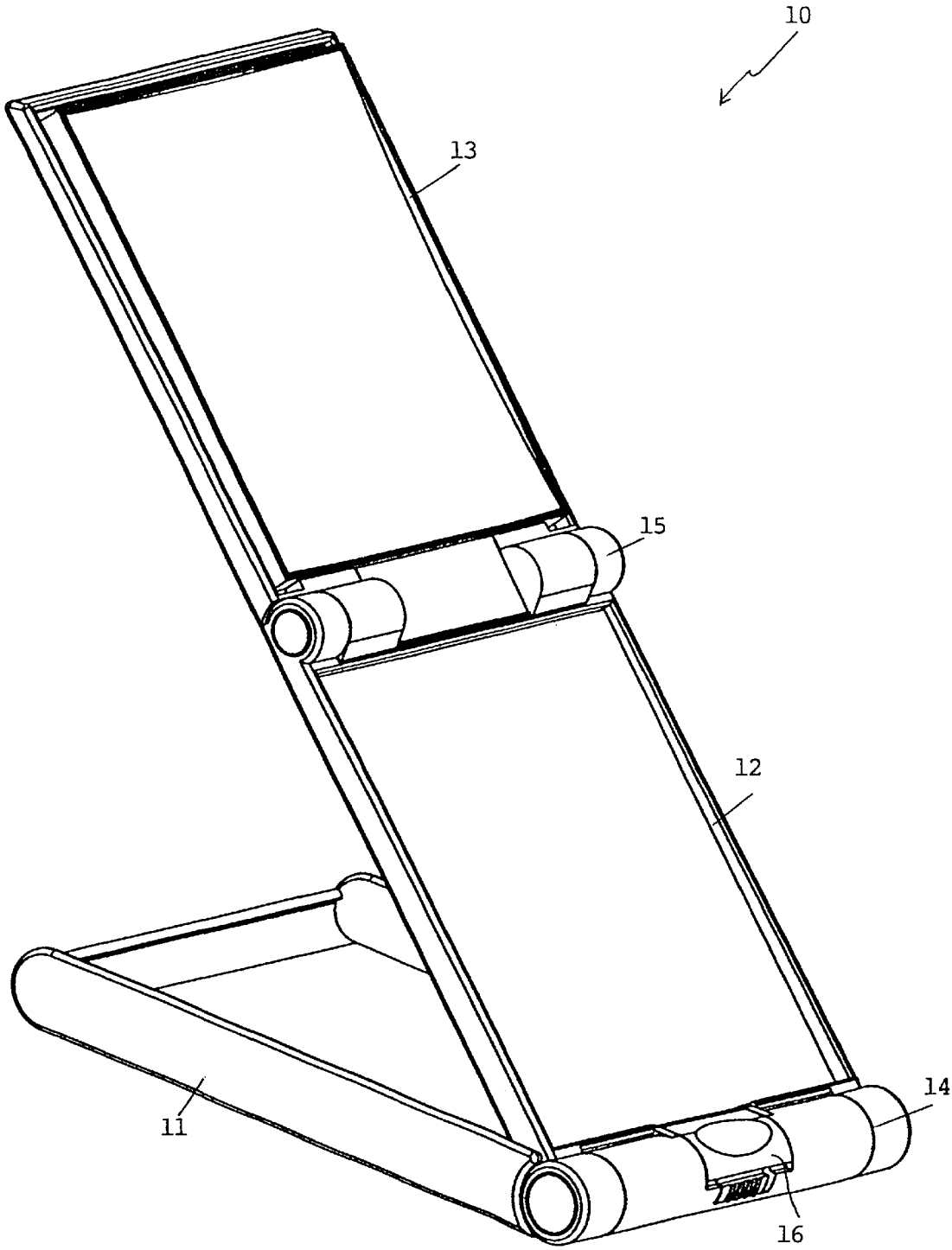
FIG. 2 is a schematic perspective illustration of the device of FIG. 1 in a fully opened configuration.
Figure 3:
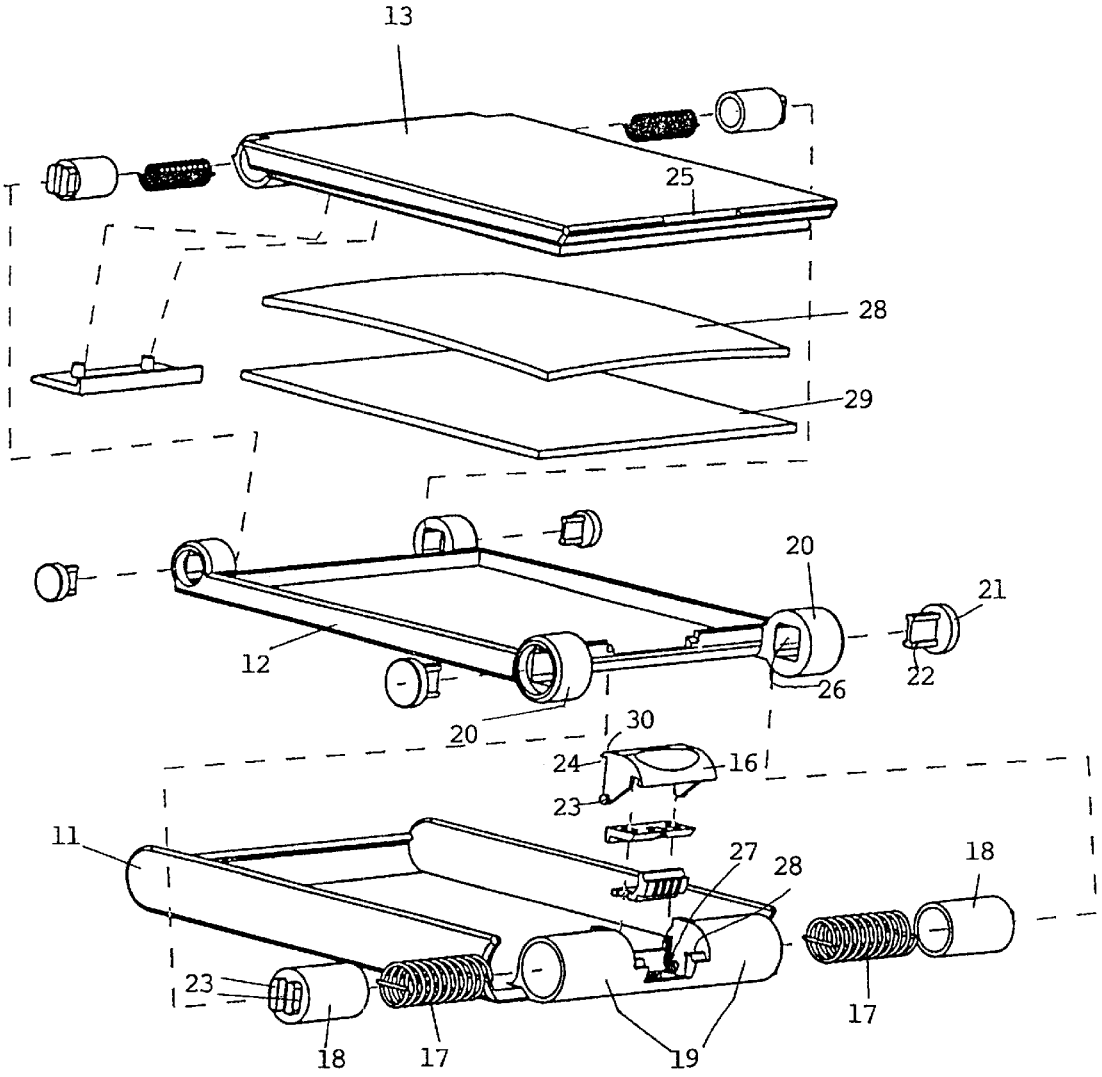
FIG. 3 is a schematic parts-exploded perspective illustration of the device of FIGS. 1 and 2 in a closed configuration.

The springs 17 are pre-tensioned so as to bias the panels 12 and 13 toward the configuration depicted in FIG. 2 in which the two panels are substantially co-planar. That is, the loading of the springs 17 causes rotation of the respective shafts 18. Because the shafts 18 rotate in unison with the outboard cylindrical portions 20, the panels are biased toward the open configuration. A viscous lubricant such as a synthetic white grease is applied between the exterior surface of the shafts 18 and the interior surface of the respective inboard cylindrical portions 19. This provides dampening to the pivotal movement of the panels.

There is a catch 16 assembled upon the base 11 and the hinge 14. The catch 16 includes opposed pins 23 to be received within holes 27 of the base 11. The catch 16 also includes a lip 24 that fits over a recessed edge 25 of the distal panel 13. The lip 24 can have a ramped top surface 30 to enable easy closing of the distal panel 13.

There is a spring 28 formed integrally with the base 11 to bias the catch 16 into a position wherein the lip 24 extends over the edge 25 to thereby retain the panels 12 and 13 in a closed position against the bias of the is springs 17. In order to release the panels 12 and 13, finger pressure is applied to the catch 16 to release the lip 24 from the edge 25.

There is also a catch mechanism at hinge 15. The catch mechanisms comprises an edge 32 of the distal panel 13 alongside the hinge 15 that fits beneath a lip 31 extending between the side walls of the base 11. When the catch 16 is activated to release the panels 12 and 13, the springs within hinge 15 cause the distal panel 13 to pivot first. During this movement, the edge 32 disengages from the lip 31 to enable the proximal panel 12 to commence upward pivotal movement by action of the springs at hinge 14.

The distal panel 13 might retain a mirror or a pane of glass 28 behind which a photograph for example might be retained. Likewise, the proximal panel 12 might retain a mirror or a pane of glass 29.

It should be appreciated that modifications and alterations obvious to those skilled in the art are not to be considered as beyond the scope of the present invention. For example, further hingedly articulated panels can extend from the distal panel 13 to provide additional display areas.

What is claimed is:

1. An image display device comprising:

a base, a proximal panel connected to the base by a spring-loaded hinge and comprising an image display area, a distal panel connected directly to the proximal panel via a spring-loaded hinge and also comprising an image display area, and a catch releasably attaching the distal panel to the base and activatable to release the proximal and distal panels from a storage configuration at the base to be moved by action of the spring-loaded hinges to a display configuration.

2. The device of claim 1 wherein the hinges each comprise co-linear cylinders connected by a shaft.

3. The device of claim 2 wherein the shaft is connected to a coil spring that is located within one of the cylinders to rotationally bias the other cylinder.

4. The device of claim 3 wherein there is a lubricant between the shaft and said one of the cylinders.

5. The device of claim 3 wherein the other of said cylinders has a non-circular hollow co-operating with projections of the shaft so as to rotate therewith.

6. The device of claim 5 further comprising an end cap attached to the shaft through an end of said other of the cylinders.

7. The device of claim 6 wherein the end cap comprises a projection that co-operates non-rotationally with the projections of the shaft.

8. The device of claim 1 wherein one or each said image display area receives a photograph.

9. The device of claim 1 wherein one or each said image display area receives a mirror.

10. The device of claim 1 wherein the proximal and distal panels are substantially encased within the base when in the storage configuration.

11. The device of claim 1 wherein the catch is attached pivotally to the base and comprises a lip that co-operates with an edge of the distal panel.

* * * * *